US009797690B1

(12) United States Patent
Warren

(10) Patent No.: US 9,797,690 B1
(45) **Date of Patent: *Oct. 24, 2017**

(54) ARMOR SYSTEM

(71) Applicant: ARMOR DYNAMICS, INC., Kingston, NY (US)

(72) Inventor: David Warren, Stone Ridge, NY (US)

(73) Assignee: ARMOR DYNAMICS, INC., Kingston, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/262,718

(22) Filed: Sep. 12, 2016

Related U.S. Application Data

(63) Continuation of application No. 13/999,597, filed on Mar. 12, 2014, now Pat. No. 9,441,918, which is a continuation-in-part of application No. 13/753,853, filed on Jan. 30, 2013, now Pat. No. 9,207,046, which is a continuation of application No. 13/237,691, filed on Sep. 20, 2011, now Pat. No. 8,387,512, which is a continuation of application No. 12/385,126, filed on Mar. 31, 2009, now Pat. No. 8,104,396, which is a continuation-in-part of application No. 11/979,309, filed on Nov. 1, 2007, now Pat. No. 7,628,104, and a continuation-in-part of application No. 11/978,663, filed on Oct. 30, 2007, now Pat. No. 8,074,553, said application No. 11/979,309 is a continuation of application No. 11/296,402, filed on Dec. 8, 2005, now Pat. No. 7,383,761.

(60) Provisional application No. 61/779,658, filed on Mar. 13, 2013, provisional application No. 61/064,851, filed on Mar. 31, 2008, provisional application No. 60/689,531, filed on Jun. 13, 2005, provisional application No. 60/634,120, filed on Dec. 8, 2004.

(51) Int. Cl.
*F41H 5/007* (2006.01)
*F41H 5/04* (2006.01)

(52) U.S. Cl.
CPC ..... *F41H 5/007* (2013.01); *F41H 5/0492* (2013.01)

(58) Field of Classification Search
CPC ..... F41H 5/007; F41H 11/14; F41H 5/02
See application file for complete search history.

(56) References Cited

U.S. PATENT DOCUMENTS

| | | | |
|---|---|---|---|
| 2,806,509 | A | 9/1957 | Bozzacco et al. |
| 3,427,139 | A | 2/1969 | Gregory |
| 3,431,818 | A | 3/1969 | King |
| 3,750,355 | A | 8/1973 | Blum |

(Continued)

FOREIGN PATENT DOCUMENTS

| | | | |
|---|---|---|---|
| DE | 2811733 | * | 10/1998 |
| DE | 2811733 | C1 | 10/1998 |
| WO | 2012085695 | A1 | 6/2012 |

OTHER PUBLICATIONS

File History of U.S. Appl. No. 13/999,597, filed Mar. 12, 2014.

*Primary Examiner* — Stephen M Johnson
(74) *Attorney, Agent, or Firm* — Sean S. Wooden; Andrews Kurth Kenyon LLP

(57) ABSTRACT

Armor systems are described. Armor systems include an armor that includes a container, in which the container includes a bottom, a top and sides and is enclosed, hollow spheres that are placed in a stack in the container, explosive that is wrapped around each of the hollow spheres in the container, in which the explosive-wrapped spheres substantially fill the container.

16 Claims, 20 Drawing Sheets

(56) References Cited

U.S. PATENT DOCUMENTS

| | | | |
|---|---|---|---|
| 3,860,052 | A | 1/1975 | Schroeder |
| 4,081,581 | A | 3/1978 | Littell |
| 4,111,097 | A | 9/1978 | Lasker |
| 4,111,713 | A | 9/1978 | Beck |
| 4,186,648 | A | 2/1980 | Clausen et al. |
| 4,665,794 | A | 5/1987 | Gerber et al. |
| 4,821,620 | A | 4/1989 | Cartee et al. |
| 4,953,442 | A | 9/1990 | Bartusk |
| 5,087,516 | A | 2/1992 | Groves |
| 5,266,379 | A | 11/1993 | Schaeffer et al. |
| 5,293,806 | A | 3/1994 | Gonzalez |
| 5,376,443 | A | 12/1994 | Sijan et al. |
| 5,517,894 | A | 5/1996 | Bohne et al. |
| 5,723,807 | A | 3/1998 | Kuhn, II |
| 5,967,211 | A | 10/1999 | Lucas et al. |
| 6,034,155 | A | 3/2000 | Espeland et al. |
| 6,112,635 | A | 9/2000 | Cohen |
| 6,370,690 | B1 | 4/2002 | Neal |
| 6,408,734 | B1 | 6/2002 | Cohen |
| 6,532,857 | B1 | 3/2003 | Shih et al. |
| 6,575,075 | B2 | 6/2003 | Cohen |
| 6,635,357 | B2 | 10/2003 | Moxson et al. |
| 6,642,159 | B1 | 11/2003 | Bhatnagar et al. |
| 6,713,008 | B1 | 3/2004 | Teeter |
| 6,959,744 | B2 | 11/2005 | Sandstrom et al. |
| 6,962,102 | B1 | 11/2005 | Johnston et al. |
| 7,080,587 | B2 | 7/2006 | Benyami et al. |
| 7,216,576 | B2 | 5/2007 | Henry et al. |
| 7,300,893 | B2 | 11/2007 | Barsoum et al. |
| 7,866,248 | B2 | 1/2011 | Moore et al. |
| 7,908,959 | B2 | 3/2011 | Pavon |
| 8,272,311 | B2 | 9/2012 | Cannon |
| 9,441,918 | B1 * | 9/2016 | Warren ..... F41H 5/007 |
| 2002/0178900 | A1 | 12/2002 | Ghiorse et al. |
| 2004/0083880 | A1 | 5/2004 | Cohen |
| 2008/0264243 | A1 | 10/2008 | Lucuta et al. |

* cited by examiner

ARMOR SYSTEM

CROSS-REFERENCE TO RELATED APPLICATIONS

This application is a continuation of U.S. patent application Ser. No. 13/999,597, now U.S. Pat. No. 9,441,918, entitled "Armor System" and filed Mar. 12, 2014, which claimed the priority of U.S. Provisional Patent Application No. 61/779,658, entitled "Armor System" and filed Mar. 13, 2013. U.S. patent application Ser. No. 13/999,597, now U.S. Pat. No. 9,441,918, is also a continuation-in-part now U.S. patent application Ser. No. 13/753,853, to U.S. Pat. No. 9,207,046, entitled "Reactive Armor System and Method" and filed Jan. 30, 2013 (the '046 patent), which is a continuation of U.S. patent application Ser. No. 13/237,691, now U.S. Pat. No. 8,387,512, entitled "Reactive Armor System and Method" and filed Sep. 20, 2011 (the '512 patent), which is a continuation of U.S. patent application Ser. No. 12/385,126, now U.S. Pat. No. 8,104,396, entitled "Reactive Armor System and Method" and filed Mar. 31, 2009 (the '396 patent), which claims the priority of U.S. Provisional Application Ser. No. 61/064,851, entitled "Reactive Armor System and Method" and filed Mar. 31, 2008, and is a continuation-in-part of U.S. patent application Ser. No. 11/979,309, now; U.S. Pat. No. 7,628,104 (the '104 patent), entitled "Methods and Apparatus for Providing Ballistic Protection" and filed Nov. 1, 2007, and U.S. patent application Ser. No. 11/978,663, now U.S. Pat. No. 8,074,553 (the '553 patent), entitled "Apparatus for Providing Protection From Ballistic Rounds, Projectiles, Fragments and Explosives" and filed Oct. 30, 2007, which are a continuation and continuation-in-part, respectively, of U.S. patent application Ser. No. 11/296,402, now, U.S. Pat. No. 7,383,761 (the '761 patent), entitled "Methods and Apparatus for Providing Ballistic Protection" and filed Dec. 8, 2005, which claimed priority of both U.S. Provisional Application No. 60/689,531, entitled "Method and Apparatus for Providing Ballistic Protective Material and Method of Making Same" and filed Jun. 13, 2005, and U.S. Provisional Patent Application No. 60/634,120, entitled "Method and Apparatus for Providing Ballistic Protective Material and Method of Making Same" and filed Dec. 8, 2004. The above applications and patent are all incorporated herein in their entirety by reference.

BACKGROUND

Light-weight vehicles are being subjected to a growing and significant problem, Explosively Formed Projectiles (EFPs). EFPs are highly dense solid matter traveling at 7,000 to 8,000 fps with very high kinetic energy making it much harder to stop using a flying plate method.

Even more problematic are weapons, such as anti-tank rounds, that are shape-charges that create high-velocity molten jets with a tip velocity of about 9,000 meters per second (mps). These rounds use a conical shape charge capable of producing a high temperature jet delivering a tremendous amount of energy on a single point. Such weapons can defeat most types of armor.

Stopping a Projectile

The basic concept in stopping a projectile is that work must equal energy. The more work the armor can do on the projectile, the more kinetic energy it can absorb. Conventional armor augments work by increased frictional force through hardness, tensile strength and thickness of the armor system.

Normal force is what gives rise to the friction force, the magnitudes of these forces being related by the coefficient of friction "μ" between the two materials:

$$f=\mu N$$

Therefore, given the mass and velocity of the projectile a simple equation would define the thickness "d" and "f" force to stop the projectile. See Diagram 1.

The hydrodynamic impact of an EFP or a shape charge delivers an enormous amount of energy. In the past, stopping an EFP has been directly related to the density of the armor. It has always been a balance between weight and thickness. The current solution of using rolled homogeneous armor (RHA) backing with Polyethylene and other composites is not a viable solution for light-weight vehicles. For example, to defeat a medium EFP the required armor would be 12-16 inches thick and 80-120 lbs/psf. Using this logic to stop the large threat the armor system would need to be more than 21 inches thick.

Conventional reactive armor systems produce significant back pressure and lethal secondary fragments. When designing a proactive armor for light-weight vehicles, minimizing back pressure as well as harmful secondary fragments are major factors to consider.

SUMMARY

Embodiments overcome disadvantages of the prior art. Embodiments overcome these disadvantages and provide other advantages by providing an armor that includes a container, in which the container includes a bottom, a top and sides and is enclosed, hollow spheres that are placed in a stack in the container, explosive that is wrapped around each of the hollow spheres in the container, in which the explosive-wrapped spheres substantially fill the container.

Embodiments overcome these disadvantages and provide other advantages by providing an armor system that includes a rectangular container that includes a bottom, a top and sides, a plurality of hollow shapes of a variety of sizes that are placed in the rectangular container, explosive material that is wrapped around each of the hollow shapes substantially enclosing each of the hollow shapes and explosive material that is placed in the container and fills spaces between the explosive-wrapped hollow shapes.

DESCRIPTION OF THE DRAWINGS

The detailed description will refer to the following drawings, wherein like numerals refer to like elements, and wherein.

DETAILED DESCRIPTION

Described herein are embodiments of an armor system and method for defeating shape-charges, armor piercing rounds, EFPs, RPGs and other threats to personnel, vehicles, buildings and property. In bridging the gap between conventional reactive armor systems and the need to minimize back pressure and dangerous secondary fragments, embodiments provide a focused, directional system that results in little back pressure using a minimal amount of explosive but still provides protection against shape-charges and EFPs. Embodiments provide a new armor system designed for light-weight armored vehicles that is both passive and reactive to defeat shape-charges, armor piercing rounds and EFPs. This armor system provides a higher percentage of vehicle coverage compared to conventional reactive armor.

Embodiments described herein are designed to defeat shape-charges, EFPs and other threats by using explosive charges, focusing a tremendous amount of kinetic energy at the point of contact.

| Performance Capabilities: | |
|---|---|
| Conventional Reactive Armor | Armor Described Herein |
| Ineffective against EFPs | Anti-EFP armor system |
| Produce tremendous backpressure | Minimize backpressure |
| Enormous secondary frags | Reduces secondary frags |
| Heavy | Light |

| Conventional Passive Armor | Armor Described Herein |
|---|---|
| Thick and bulky | Low profile |
| Heavy | Lightweight |
| Tremendous over pressure | Reduces over pressure |
| Greatly reduce vehicle mobility | Minimal impact on vehicle mobility |

Embodiments described herein provide an armor system that has the following characteristics:

| | |
|---|---|
| Multi-Threat Capability | Has the ability to take multiple hits from a varying combination of threats (ball rounds, armor piercing and shape charges). |
| Light Weight | Is designed for light weight vehicles. |
| Scalable | May be customized to meet varying threats. |
| Minimize Secondary Fragments | Minimizes collateral damages and reducing secondary fragmentation. |
| Reduce Back Pressure | Proactive counter response minimizes shock trauma effects to vehicle compartments. |
| Low Profile | Low profile minimizes the impact to the vehicle's overall dimensions and reduces the impact on the vehicles functionality. |

Building on the Magmacore™ armor concept of a three-dimensional matrix for displacing energy, as described in the '761 patent and other related applications described above, the embodiments described herein provide a viable armor to defeat shape-charges, EFPs, ballistic projectiles and other threats. Embodiments described herein provide energized armor systems that incorporate three-dimensional components and principles that represent a continual evolution from the inventive concepts described in the related applications described above.

Figure 1B:
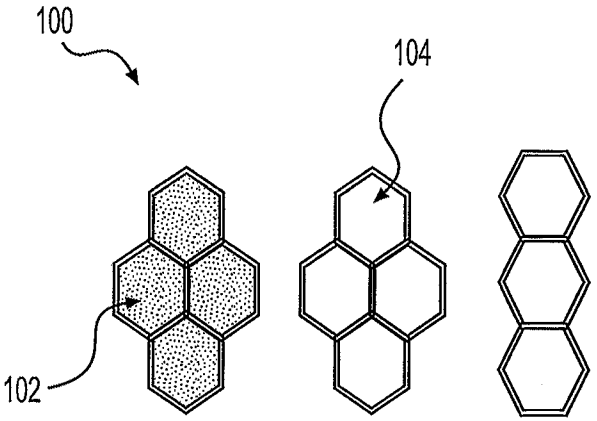
FIGS. 1A and 1B are diagrams illustrating embodiments of three-dimensional shapes or tiles used in armor described in the '396 patent.
Figure 1A:
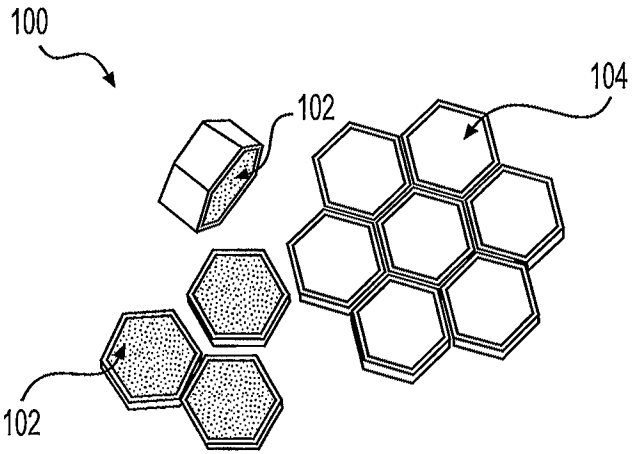

With reference now to FIGS. 1A-1B, embodiments of tiles 100 used to provide a unique three-dimensional core of embodiments of armor systems described in the '761 patent are shown. These figures are reproduced here because they help illustrate the evolution of the armor concepts from related applications described to the present application. Tiles 100 are hexagonal-shaped and may be placed together as shown. The embodiments shown illustrate different geometric arrangements of tiles 100, such as linear groupings or wider groupings. As described in the "761 patent, the tiles may be hexagonal, square, spheres, or other geometric, three-dimensional shapes. Likewise, each tile shown may have a hollowed out section or space 102 in which other material may be placed. In embodiments, the hollowed out space 102 may extend all the way through the center of tiles 100 or part-way through. If part-way through, the hollowed out space 102 may be on one side or both sides of tile 100. In embodiments, the space 102 may be filled with a plastic explosive or other explosive material 104. The plastic explosive or other explosive material 104 may provide the reactive component of the reactive armor.

In the embodiment shown, the explosive material 104 is pentaerythritol tetranitrate (PETN). In the embodiment shown in FIG. 1A, tiles 100 may be filled with 1 gram of PETN explosive material 104 per tile 100. In the embodiment shown in FIG. 1B, ceramic tiles 100 may be filled with 2 grams of PETN explosive material 104 per tile 100. The different amounts of explosive material 104 may be determined by the volume of the hollowed out space 102 in tiles 100. In the embodiment shown in FIG. 1A, for example, the hollowed out space 102 may be large enough to permit up to a 1 gram of explosive material 104. In the embodiment shown in FIG. 1B, for example, the hollowed out space 102 may be large enough to permit up to 2 grams of explosive material 104. As noted in the '691 application, such tiles 100 may be sized larger or smaller depending on the nature of the expected threats. If more explosive material 104 and larger tiles 100 are needed to provide effective static armor functionality, larger tiles 100 may be used.

Figure 2A:
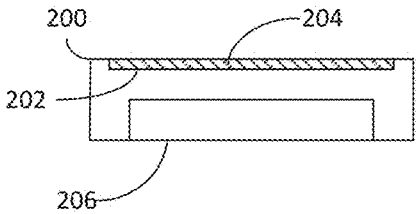
FIGS. 2A-2H are cross-section diagrams of embodiments of three-dimensional shapes or tiles that may be used in embodiments of energized armor described herein.
Figure 2E:
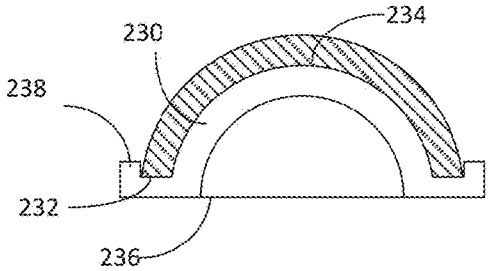
Figure 2B:
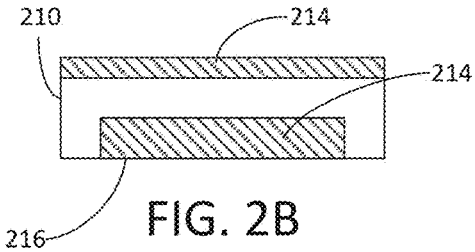
Figure 2F:
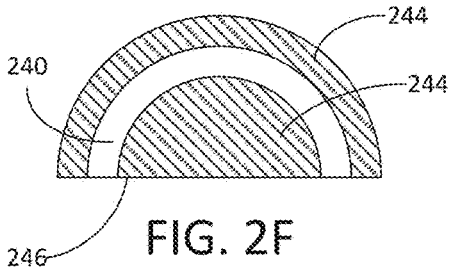
Figure 2C:
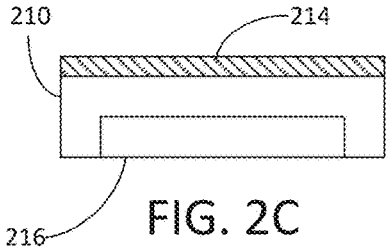
Figure 2G:
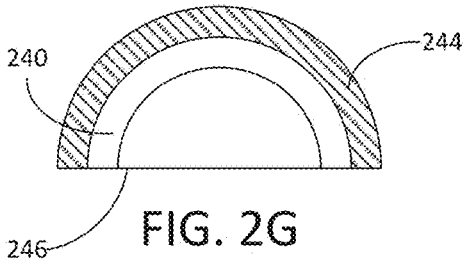
Figure 2D:
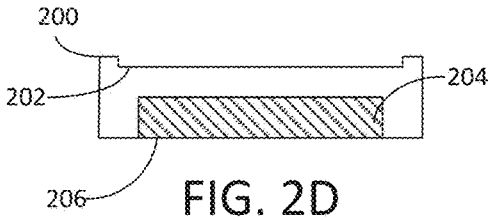

With reference now to FIGS. 2A-2H, shown are cross-sectional views (at mid-line of the shapes) of additional embodiments of three-dimensional hollow or partially hollow shapes or tiles that may be used in embodiments of armor systems described herein and in the '761 patent. With reference to FIG. 2A, shown is a cross-sectional view of a three-dimensional square shape or tile 200. The cross-sectional view of a similar three-dimensional hexagonal tile would be similar. Square tile 200 includes two hollow regions, a hollow region 202 on an upper or top surface of square tile 200 and a hollow region 206 on a lower or bottom surface of square tile 200, with explosive material 204 filing the hollow region 202 on the top or upper surface. With reference to FIG. 2B, shown is a cross-sectional view of another three-dimensional square tile 210. The cross-sectional view of a similar three-dimensional hexagonal tile would be similar. Square tile 200 includes one hollow region, hollow region 216 on a lower or bottom surface of square tile 210, with explosive material 214 filing the hollow region 216 on the lower or bottom surface and explosive material 214 covering upper or top surface. With reference to FIG. 2C, shown is a cross-sectional view of same three-dimensional square tile 210. However, explosive material 214 only covers upper or top surface of tile 210, leaving hollow space 216 empty. With reference to FIG. 2D, shown is a cross-sectional view of same three-dimensional square shape or tile 200 shown in FIG. 2A. However, explosive material 204 fills hollow space 206 and not hollow space 202.

Figure 2H:
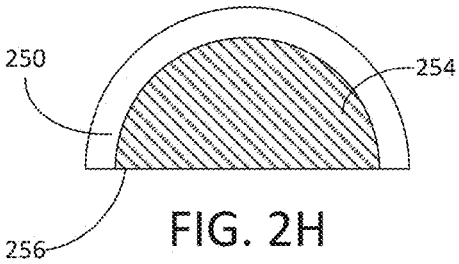

With reference to FIGS. 2E-2H, shown are cross-sectional views of three-dimensional hemisphere shapes or tiles. The hemisphere tiles are similar to square (or hexagonal) tiles in FIGS. 2A-2D. With reference to FIG. 2E, shown is cross-sectional view of three-dimensional hemisphere tile 230. Hemisphere tile 230 includes two hollow regions, a hollow region 232 on an upper or top surface of hemisphere tile 230 and a hollow region 236 on a lower or bottom surface of hemisphere tile 230, with explosive material 234 filing the hollow region 232 on the top or upper surface. Hollow space 232 may be formed by extension or ridge 238 around circumference of bottom of hemisphere tile 230. With reference to FIG. 2F, shown is a cross-sectional view of another three-dimensional hemisphere tile 240. Hemisphere tile 240 includes one hollow region, hollow region 246 on a lower or bottom surface of hemisphere tile 240, with explosive material 244 filing the hollow region 246 on the lower or bottom surface and explosive material 244 covering upper or top surface. With reference to FIG. 2G, shown is a cross-sectional view of same three-dimensional hemisphere tile 240. However, explosive material 244 only covers upper or top surface of tile 240, leaving hollow space 246 empty. With reference to FIG. 2H, shown is a cross-sectional view of another three-dimensional hemisphere shape or tile 250. In hemisphere tile 250, explosive material 254 fills hollow space 256 on bottom of hemisphere tile 250.

Figure 3A:
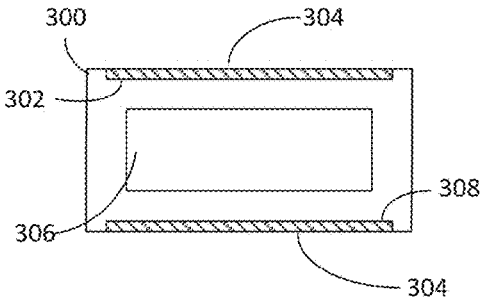
FIGS. 3A-3D are cross-section diagrams of embodiments of three-dimensional shapes or tiles that may be used in embodiments of energized armor described herein.

One of skill in the art can see that additional three-dimensional shapes shown in FIGS. 2A-2H may form one-half of larger three-dimensional shapes. In other words, three-dimensional shapes shown in FIGS. 2A-2H may be used to form larger three-dimensional shapes. With reference now to FIGS. 3A-3D, shown are cross-sectional views (at midline) of four additional three-dimensional shapes that may be formed from three-dimensional shapes shown in FIGS. 2A-2H. With reference to FIG. 3A, shown is cross-sectional view of cubic shape or tile 300. Cubic tile 300 may be formed from two square tiles 200. The cross-sectional view of a similar three-dimensional hexagonal prism tile would be similar. Cubic tile 300 includes two hollow regions, a hollow region 302 on an upper or top surface of cubic tile 300 and a hollow region 306 in center of cubic tile 300 (in other words, cubic tile 300 is a hollow cube), with explosive material 304 filing the hollow region 302. With reference to FIG. 3B, shown is a cross-sectional view of another three-dimensional cubic tile 310. Cubic tile 310 may be formed from two square tiles 210. The cross-sectional view of a similar three-dimensional hexagonal prism tile would be similar. Cubic tile 310 includes one hollow region, hollow region 316 in center of cubic tile 310 (in other words, cubic tile 310 is a hollow cube), with explosive material 314 covering upper or top and lower or bottom surface of cubic tile 310.

Figure 3C:
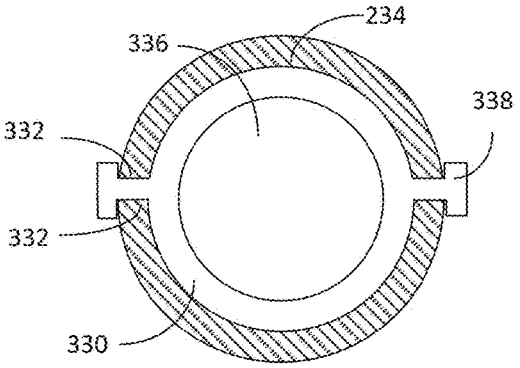
Figure 3B:
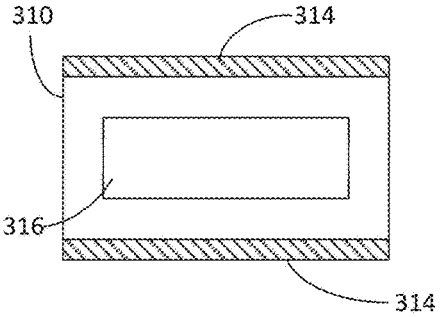
Figure 3D:
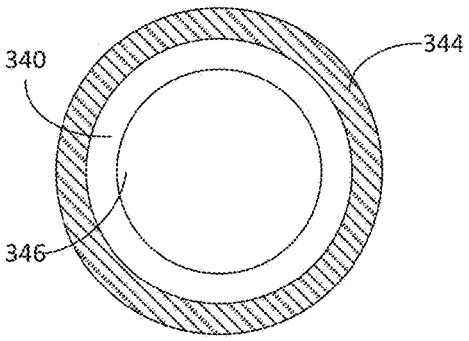

With reference now to FIG. 3C, shown is cross-sectional view of three-dimensional sphere shape or tile 330. Sphere tile 330 may be formed from two hemisphere tiles 230. Sphere tile 330 includes three hollow regions, hollow regions 332 on an upper or top surface and lower or bottom surface of sphere tile 330 and a hollow region 336 in center of sphere tile 330 (in other words, sphere tile 330 is a hollow sphere), with explosive material 334 filing the hollow regions 332. In other embodiments, explosive material fills hollow space 336. Hollow regions 332 may be formed by extension or ridge 338 around circumference at center of sphere tile 330. With reference now to FIG. 3D, shown is cross-sectional view of three-dimensional sphere shape or tile 340. Sphere tile 340 may be formed from two hemisphere tiles 240. Sphere tile 340 includes one hollow region, hollow regions 346 at center of sphere tile 340 (in other words, sphere tile 340 is a hollow sphere). Explosive material 344 covers sphere tile 340 wrapping around sphere tile 340. In other embodiments, explosive material fills hollow space 346.

Figure 4A:
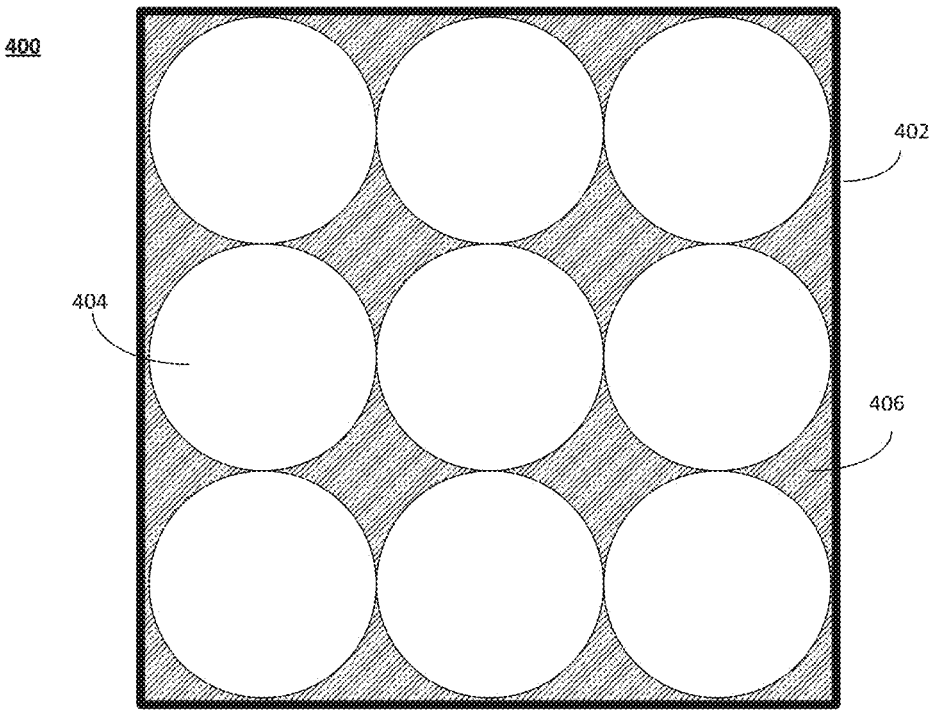
FIG. 4A is a cross-section diagram illustrating an embodiment of energized armor that includes three-dimensional shapes and explosive.
Figure 4B:
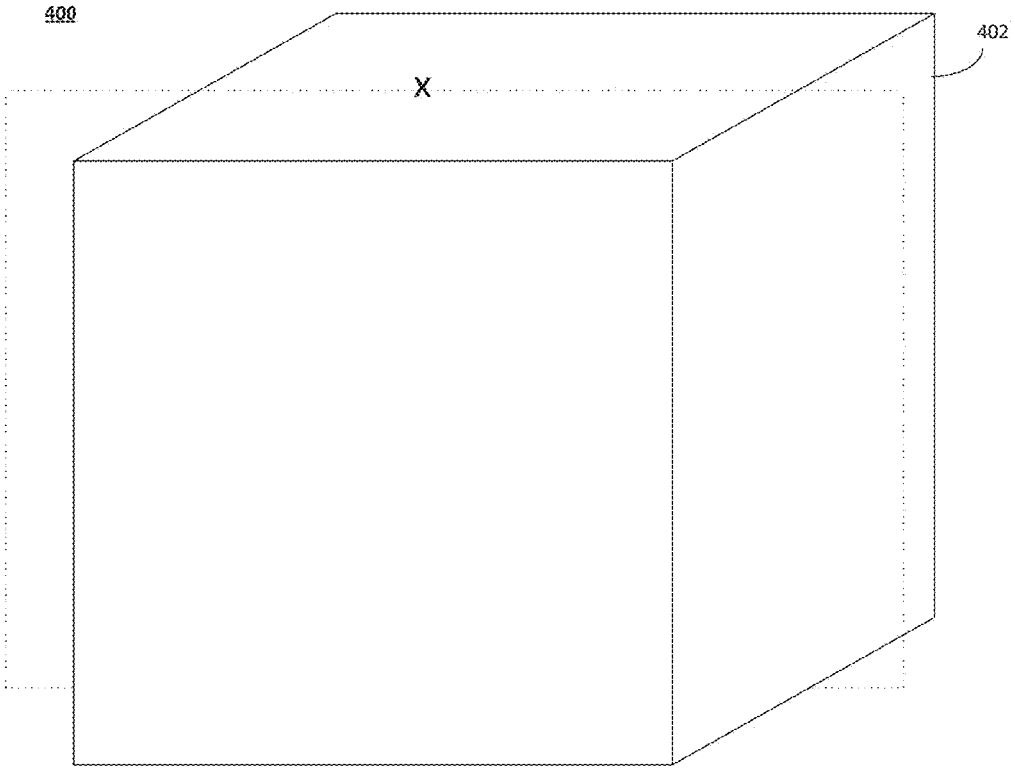
FIG. 4B is a perspective view diagram illustrating an embodiment of energized armor that includes three-dimensional shapes and explosive.

With reference now to FIGS. 4A-4B shown is an embodiment of energized armor or armor system 400 that is filled with three-dimensional hollow shapes (e.g., spheres 402) and explosive 404. The view shown in FIG. 4A is a cross-section view of armor 400. The view shown in FIG. 4B is an exterior perspective view of armor 400. The cross-section shown in FIG. 4A is of a view at the mid-line X shown in FIG. 4B. The armor system 400 shown may comprise a compartment or container 402 that makes up one section of an armor system or the entire armor system. The armor 400 shown is a cubic container 402 in which the spheres 404 are packed. The armor 400 may include any geometric shape container or compartment 402. For example, armor 402 may include triangular prism-shaped, rectangular prism-shaped, ovoid-shaped, or other three-dimensional shape container or compartments 402. Armor 400 may include a plurality of containers or compartments 402.

Armor 400 may installed onto a vehicle (e.g., armored-personnel carrier, tank, truck, HUMVEE, etc.), ship, boat, plane, helicopter, building, etc. Accordingly, container 402 may include devices or mechanisms (not shown) for attaching to such vehicle, etc. Vehicle, etc., may have system for receiving and securing armor 400 to which such attachment devices or mechanisms on container 402 attach. Multiple armor systems 400 may be installed on vehicle, etc.; in other words, vehicle, etc., may include multiple containers or compartments 402. Vehicle, etc., may include, therefore, multiple attachment systems for securing armor 400 to vehicle, etc.

With continuing reference to FIG. 4A, as mentioned above, the three-dimensional shapes in armor 400 are hollow spheres 404. As described herein, other three-dimensional shapes, e.g., cubes, ovoid, hexagonal, triangular or rectangular prisms, square tiles, hexagonal tiles, hemispheres, etc. may be used. Spheres 404 may be randomly-packed into the armor 400 or may be placed in the armor 400 in an organized, ordered manner. The armor 400 may be made of a variety of materials. In the embodiment shown, the armor 400 is plastic. The compartment or container may be made from composite materials, ceramics, or aluminum or other metal. Container 402 may even be cardboard or other material. Container 402, in such embodiments, is intended to merely hold spheres 404 and explosive 406 in place. Container 402 shown has six walls (top, bottom and four sides) with a hollow space between the walls. Container 402 is enclosed to contain the spheres 404 and the explosive 406. In the embodiment show, the armor 400 includes a four inch by four inch by four inch (4"×4"×4") cubic container or compartment 402. The armor 400 may be comprised of other size containers or compartments 402. For example, container may be 4"×4"×6" rectangular prism, 8"×8"×8" cube, 4"×4"×8" rectangular prism, etc. Dimensions of typical containers will range from 4" to 20", but, depending on the application, almost any range of sizes may be used.

Spheres 404 may be all of the same size or of varying sizes. Spheres 404 may be made of a variety of materials. In the embodiment shown, spheres 404 are hollow. Solid spheres may also be used. Spheres 404 used in armor 400 may be of uniform size. Alternatively, armor 400 may contain spheres of variety of sizes. In an embodiment, spheres 404 are one and a half inch (1.5") diameter spheres. Other size spheres 404 may be used, such as one inch (1") diameter spheres or spheres with a diameter anywhere in the range of approximately one-half inch (0.5") to approximately four inches (4"). As noted, armor 400 may include a variety of size spheres 404; for example, armor 400 may contain one inch and one and a half inch size spheres 404. Spheres 404 may be made from a variety of materials, but in embodiments are typically made from lightweight plastics. From example, spheres 404 may be made from high-density polyethylene (HDPE). Alternatively, spheres 404 may be made from polypropylene (PP). Spheres 404 may also be made from other materials, such as ceramics. Other three-dimensional shapes may be used instead of spheres.

With continuing reference to FIG. 4*a*, as discussed above, spheres 404 may be randomly or orderly packed into container 402. In the embodiment shown, the spheres 404 are packed in an orderly manner in armor 400. Explosive 406 may fill the spaces in the armor 400 between the spheres 404 (and, in some embodiments, between the spheres 404 and container 402 walls); these spaces are referred to herein as "void spaces." Any of a variety of explosives 406 may be used. For example, pentaerythritol tetranitrate (PETN), C-4, octol or low-flammable (LF) explosive 406 may be used. Likewise, embodiments may include explosive 406 hot-poured, cold-poured, packed, injected, molded or otherwise placed into the armor 400 (e.g., to fill the void-spaces). Other explosives 406 may be used.

Experiments have shown that armor 400, when used, successfully disrupts and/or otherwise negatively affects shape-charges and other threats. The typical velocity of a jet formed from a shape-charge explosion is 9000 mps. The velocity of detonation (VOD) of explosives used in energized armor depend on the density and type of explosive used. Typically, explosives used in energized armor will have a VOD less than the shape-charge detonation. However, using known explosives with a lower VOD (e.g., 7000 MPS) than the velocity of the high-speed jet, armor configured with the geometry and components of embodiments described herein is able to stop or otherwise disrupt the effects of shape-charges and the jets formed thereby. In other words, armor 400 comprising nothing more than a container 402, plastic spheres 404 and explosive 406, as described above, has been shown to be capable of effectively stopping such shape-charges. The single explosive event caused by the detonation of the explosives 406 creates multiple waveforms that somehow combine. The intersections of these multiple waveforms appears to create tremendous energy that does the work necessary to disrupt the shape-charge. It is thought that the explosions triggered surrounding around each sphere 404 collapse the spheres 404 and cause such tremendous force to be exerted towards the center of collapsing spheres 404 and away from the spheres 404 as well. These forces appear to contribute to the "amplification" of the explosive force of the detonating explosive 406 and the increase in velocity of the explosive event. In this manner, it is thought that the armor 400 is able to disrupt the shape-charge, even though the shape-charge velocity is greater than the VOD of the explosive 406.

Figure 5:
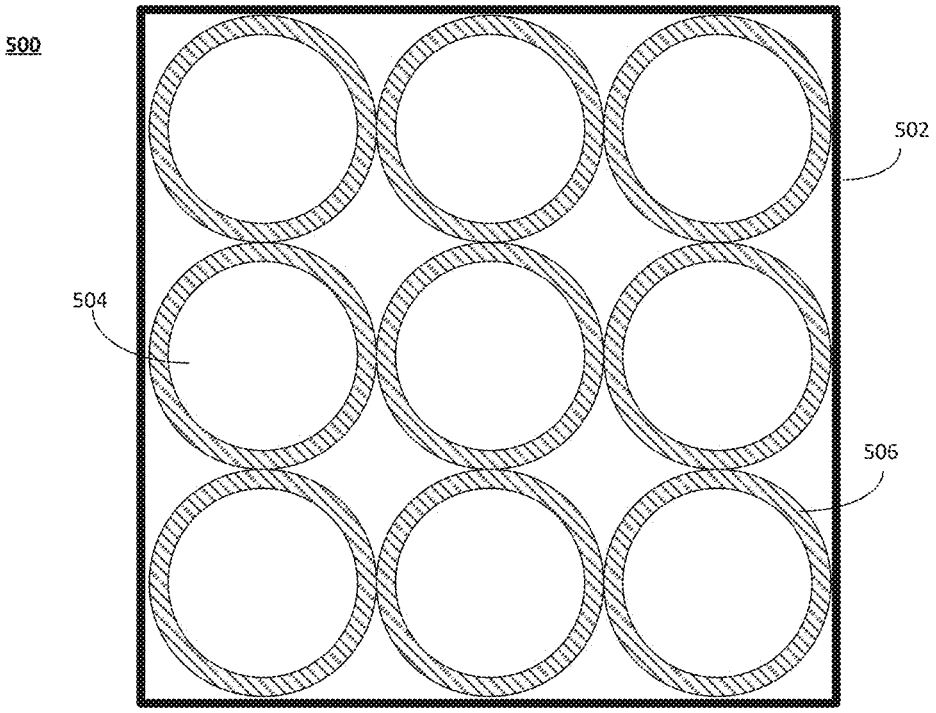
FIG. 5 is a cross-section diagram illustrating an embodiment of energized armor that includes three-dimensional shapes and explosive.

With reference now to FIG. 5, shown is another embodiment of energized armor 500 that is filled with three-dimensional hollow shapes (e.g., spheres 504) and explosive 506. The view shown in FIG. 5 is a cross-section view of armor 500 similar in perspective to the view shown in FIG. 4A. In embodiment of armor 500 shown, container 502 includes spheres 504 wrapped in explosive 506. Explosive 506 may be a flexible explosive, such as PETN explosive, that is used to wrap the spheres 504. Each sphere 504 or some portion of the spheres 504 in container 502 may be wrapped in explosive 506. In armor 500, each sphere 504 is wrapped in explosive 506 and one or more sheets 208 of explosive 506 are placed at various places in armor, such as on top of stack of spheres 504 in container 502, or between various layers of spheres 504. For example, a six (6) gram sphere 504 may be wrapped in explosive 506 using two (2) thin, eight (8) gram PETN (or other malleable explosive) explosive discs. The explosive 506 may be tightly wrapped around the spheres 506 in a thin layer, leaving space between the explosive-wrapped spheres 506. Accordingly, while explosive 506 may surround the spheres 504, void spaces between spheres 504 may remain empty or partially empty (i.e., explosive may not fill all of the void spaces between spheres 504).

Figure 6:
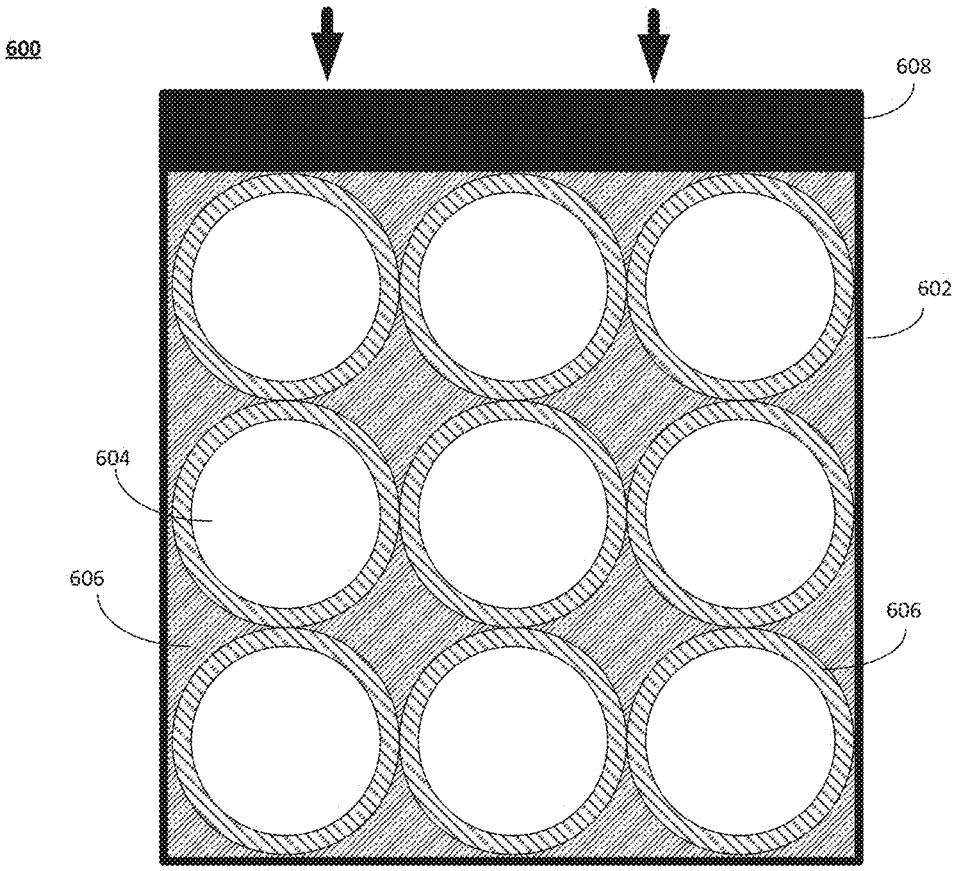
FIG. 6 is a cross-section diagram illustrating an embodiment of energized armor that includes three-dimensional shapes and explosive.

With reference now to FIG. 6, shown is another embodiment of energized armor system 600 that is filled with three-dimensional hollow shapes (e.g., spheres 604) and explosive 606. The view shown in FIG. 6 is a cross-section view of armor 500 similar in perspective to the view shown in FIG. 4A. Armor system 600 includes container 602, spheres 604, and explosive 606. Armor system 600 also includes static armor 608 that is placed on threat-side (e.g., side of armor away from vehicle and facing towards possible threats). The thick arrows in FIG. 6 indicate the direction of threats. Static armor 608 may be, for example, steel plate. Alternatively, static armor 608 may be an embodiment of static armor described in the '404, '553 and '761 patents, which are incorporated by reference. Static armor 608 may be included in armor system 600 in order to protect energized components of energized armor system 600 (e.g., the explosive 606) from accidental or purposeful detonation from small-arms fire or other impacts short of the threats armor system 600 is intended to defeat (e.g., less than anti-armor shape-charges).

As noted above, explosive may also fill void-spaces between spheres. In armor system 600, explosive 606 fills void-spaces between explosive-wrapped spheres 604. Consequently, FIGS. 4A, 5 and 6 illustrate three different arrangements of explosive in embodiments of energized armor systems with three-dimensional shapes and explosive described herein: explosive in void-spaces between hollow spheres, explosive wrapped around hollow spheres, and explosive in void-spaces between explosive-wrapped, hollow spheres. As noted, different three-dimensional shapes may replace spheres and additional explosive (e.g., explosive sheets or strips) may be placed in armor systems.

With reference now to FIGS. 7A-K, shown are various configurations of spheres 704 that may be used in embodiments of energized armor systems described herein. These Figures show examples of how the spheres 704 may be arranged, packed and stacked in energized armor systems described herein. Spheres 704 in FIGS. 7A-K are hollow spheres wrapped in explosive 706, as in embodiment of armor 500 described with reference to FIG. 2. Spheres arranged as shown in FIGS. 7A-K may also be solid spheres, explosive filled spheres and spheres not wrapped in explosive.

Figure 7A:
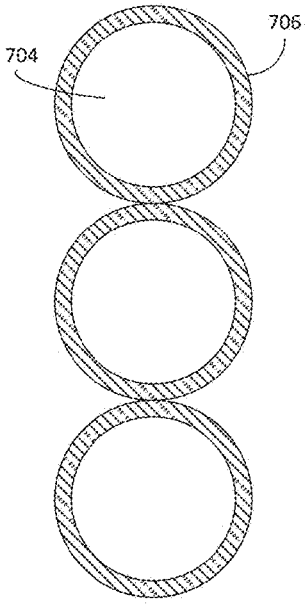
FIGS. 7A-7K are diagrams illustrating various arrangements and configurations of three-dimensional shapes and explosives used in embodiments of energized armor.

With reference now to FIG. 7A, shown is a cross-sectional view of a single-column stack of spheres 704. As shown, spheres 704 are hollow. Explosive 706 is wrapped around spheres 704 to provide stack of explosive-wrapped spheres 704. The view shown is a cross-sectional side view of stack of spheres 704 and explosive 706 wrapped around spheres.

The stack shown in FIG. 7A, and in FIGS. 7A-K, are shown as including three layers or levels of spheres 704 (in FIG. 7A, simply a three-sphere tall stack). It is noted that embodiments of armor may include more or less layers or levels of spheres 704 (e.g., more or less than three-sphere tall stacks). The height of the armor container, the diameter of the spheres 704, and the orientation of each layer (see below) determines how many layers of spheres 704 may be placed into the armor.

Figure 7B:
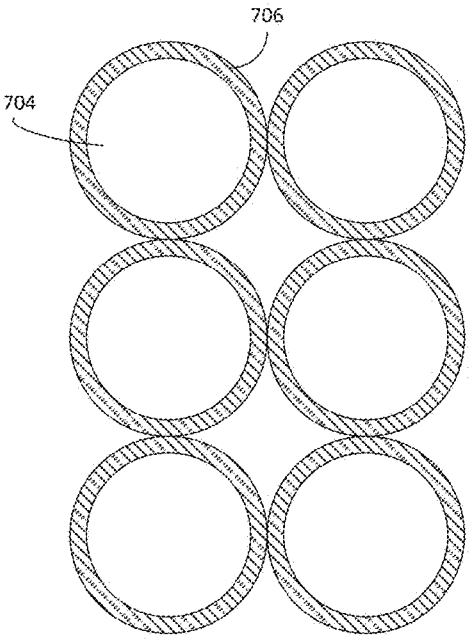
Figure 7C:
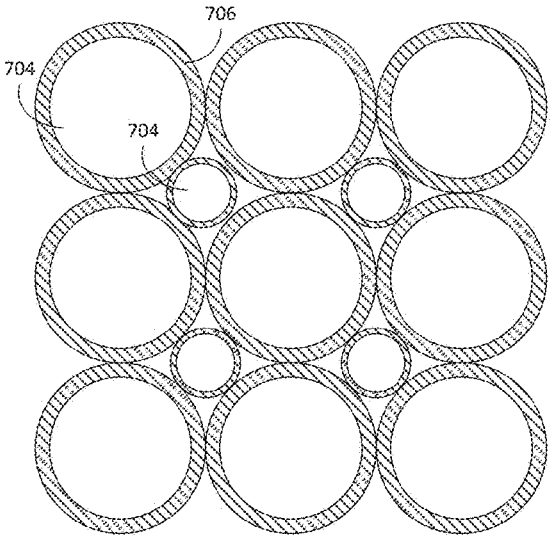

Additional stacks of spheres 704 may be included in embodiments of armor, depending on width of armor container and diameter of spheres 704. With reference now to FIG. 7B, shown is a double-column stack of spheres 704. As in FIG. 7A, spheres 704 are wrapped in explosive 706. Only the size of the armor container limits the number of stacks of spheres 704 that may be included in armor With reference now to FIG. 7C, shown is a triple-column stack of spheres 704. As above, spheres 704 are wrapped in explosive 706. Between the spheres and the columns of spheres 704 are "void-spaces." In embodiment shown, smaller-diameter spheres 704 are placed in at least some of the void-spaces. The smaller-diameter spheres 704 are also wrapped in explosive 706.

Figure 7D:
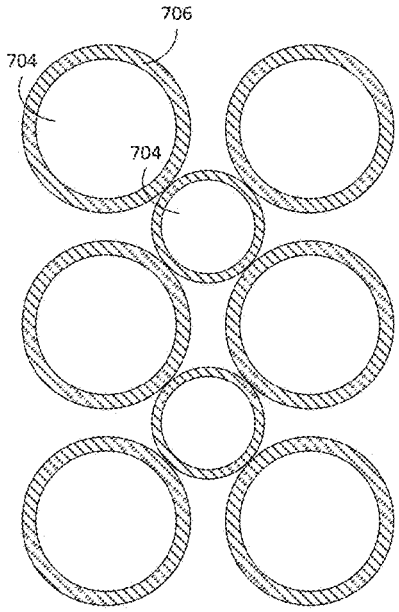

Such void-spaces may exist between spheres 704 and columns of spheres 704 in a double-column stack of spheres 704, as shown in FIG. 7D. Here, smaller-diameter spheres 704 are also placed between spheres 704. The smaller-diameter spheres 704 in the embodiment shown in FIG. 7D are large enough to create gaps between the larger-diameter spheres 704 in the columns, as shown. The smaller spheres 704 are also wrapped in explosive 706.

Figure 7E:
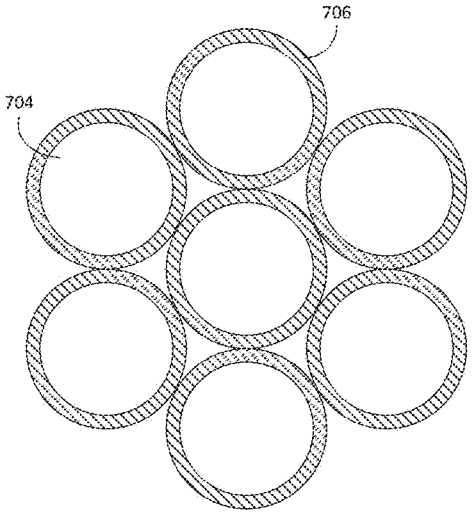

As described above, the views of stacks shown in FIGS. 7A-7D are cross-sectional side views of the stacks of spheres 704. With reference now to FIG. 7E, shown is a top, cross-sectional view of stacks of spheres 704. Shown is a cross-sectional view of one-layer of spheres 704 wrapped in explosive 706. If looked at from the side, the stacks of spheres 704 shown in FIG. 7E would consist of three double-stacks of spheres 704 (the six (6) outer spheres 704) and one single-stack of spheres 704 (the middle sphere 704). The stacks of spheres 704 may have multiple layers of spheres 704 (e.g., the three layers shown in FIG. 7A-7D).

Figure 7F:
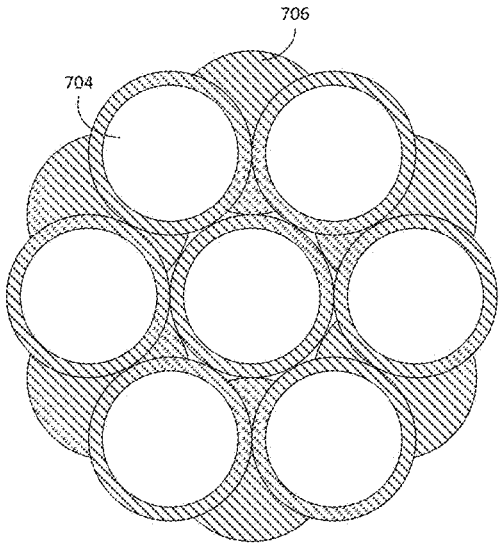

With reference now to FIG. 7F, shown is another top, cross-sectional view of a layer of spheres 704 placed on top of another layer of spheres 704. As shown, the top layer of spheres 704 is rotated in relation to the layer below (which corresponds in orientation to the layer of spheres 704 shown in FIG. 7E). The layer below is not shown in cross-section. The top layer of spheres 704 is rotated approximately 30 degrees in relation to the layer below. This rotation enables the spheres 704 top layer to sit or pack more tightly with the layer of spheres 704 below. This effectively reduces the amount of void-spaces and allows for tighter packing of spheres 704.

Figure 7G:
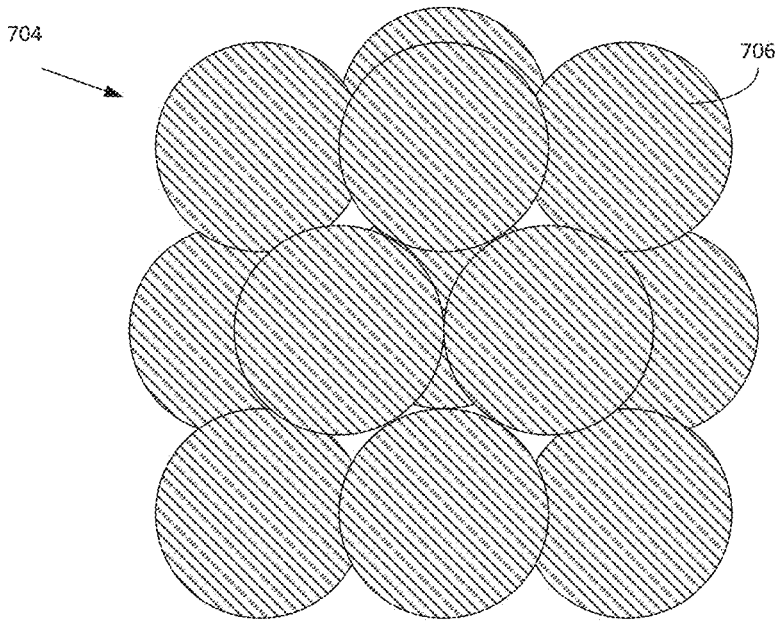

With reference now to FIG. 7G, shown is a side, non-cross-sectional view of three layers of spheres 704. The spheres 704 in the embodiment shown are wrapped in explosive 706. Each layer of spheres 704 is rotated in relation to the layer of spheres 704 that layer. The causes the spheres 704 in each layer to be offset from the spheres 704 below. As can be seen, this enables significantly greater packing of spheres 704 and, therefore, smaller void-spaces. It is noted that the spheres 704 in the center of the layers are not offset from one another (each center sphere 704 is sitting directly on top of sphere 704 below). Accordingly, as shown in FIG. 7G, the spheres 704 in the center will be higher.

Figure 7H:
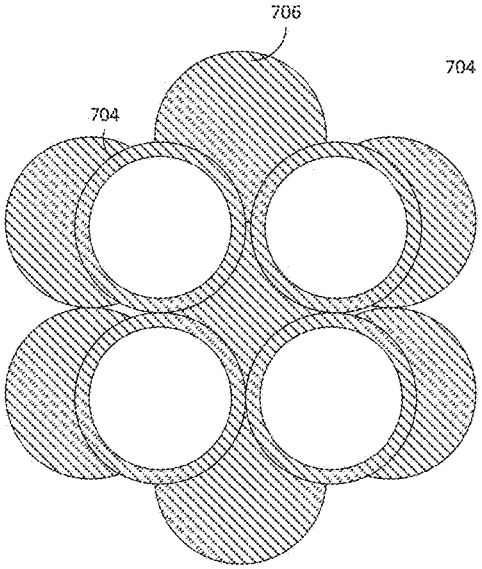
Figure 7I:
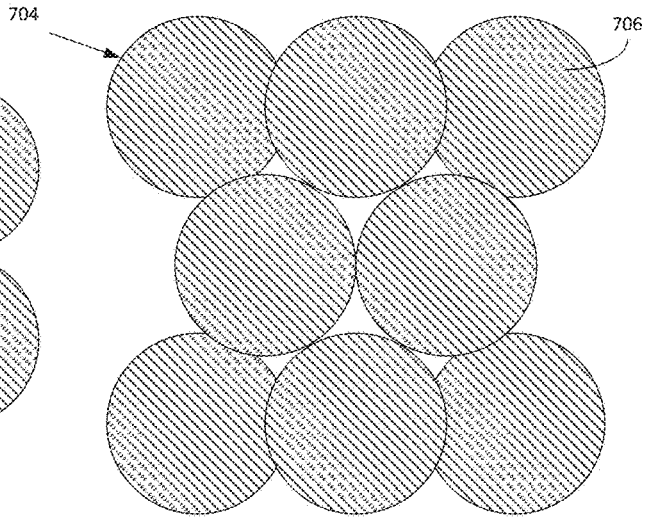

With reference now to FIG. 7H, shown is a top, cross-sectional view of a layer of spheres 704 on top of another layer of spheres 704. Here to, the top-layer of spheres 704 are offset from the layer below. However, the top layer of spheres 704 only contains four spheres 704 as opposed to the seven spheres 704 below. This enables the spheres 704 to be tightly packed without center spheres 704 having to sit directly on top of other center spheres 704, as in FIG. 7G. With reference to FIG. 7I, shown is a side, non-cross-sectional view of three layers of spheres 704 arranged as in FIG. 7H. The gaps between outer spheres 704 may be filled in with hemi-spheres 704 or smaller spheres 704.

Figure 7J:
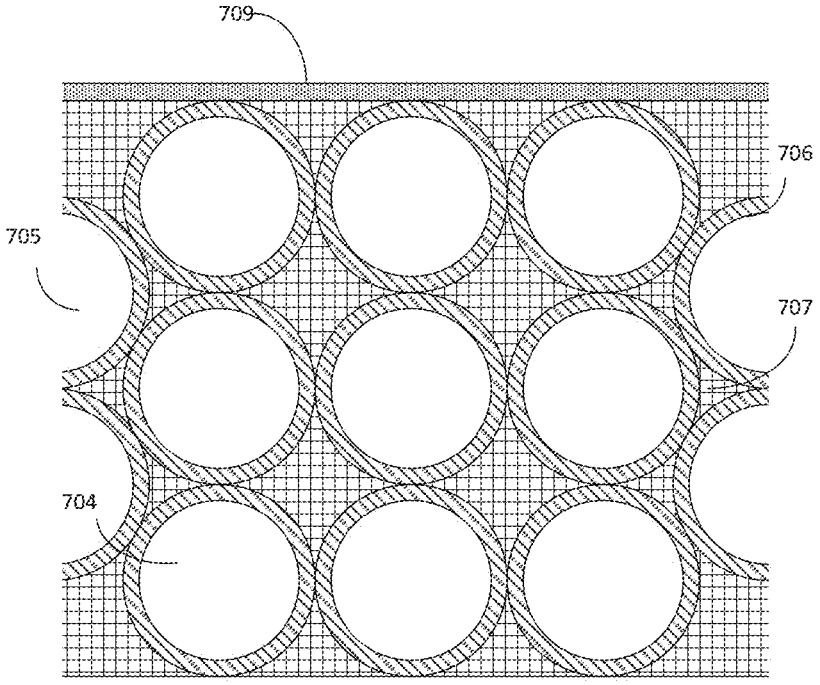
Figure 7K:
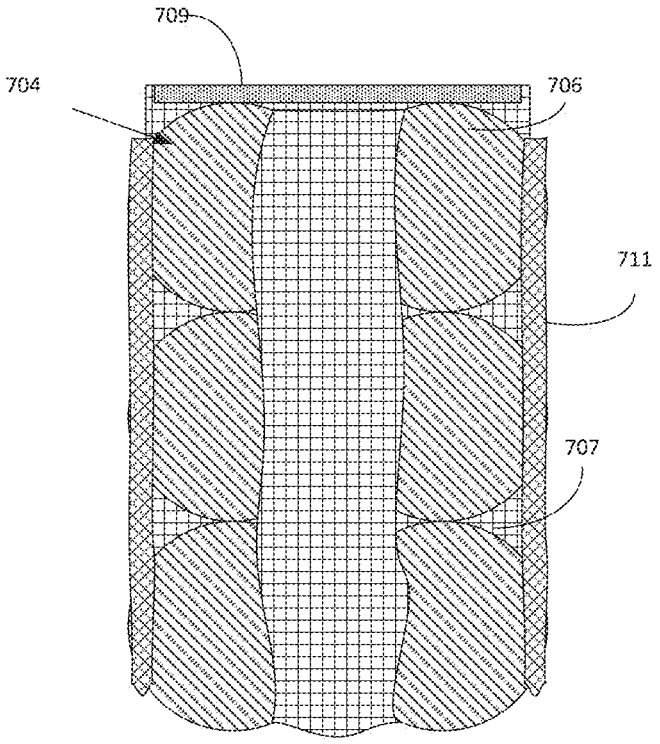

With reference now to FIG. 7J, shown is a cross-sectional side view of multiple layers and stacks of spheres 704 that are wrapped in explosive 706. In this embodiment, there is a triple-stack of spheres 704, as in FIG. 7C. There are also explosive-wrapped hemi-spheres 705 filling spaces between spheres 704. Moreover, there is explosive fill 707 filling void-spaces between spheres 704 (and hemi-spheres 705). As described above, explosive fill 707 may be a hot-pour explosive poured into armor container after spheres 704 are packed into container. Alternatively, explosive fill 707 may simply be explosive, such as plastic explosive, placed into container prior to and after each layer of spheres 704 are placed into container. Also shown is a sheet explosive 709 that is placed on top of a top layer of spheres 704. Sheet explosive 709 may be PETN or other sheet explosive (RDX, HMX, etc.). Sheets of sheet explosive 709 may be placed between each layer of spheres 704. Alternatively, strips of explosive (not shown) may be placed around spheres 704 and stacks of spheres 704 at various locations With reference now to FIG. 7K, shown is a side view of a double-stack of spheres 704 wrapped in explosive 706. Explosive strips 711 are also placed around the stacks of spheres 704 as shown. An explosive sheet 709 is placed on top of the stack of spheres 704. Explosive fill 707 fills void spaces between the spheres 704. This illustrates that embodiments may include a variety of configurations of explosive material placed around the spheres 704 and on top of the spheres 704. Embodiments of armor may omit or use any combination of the explosive shown in FIG. 7K (e.g., no explosive fill 707, no explosive sheet 709 or additional explosive sheets 709 between layers of spheres 704 or on bottom of stacks, no explosive strips 711, etc.).

Figure 8:
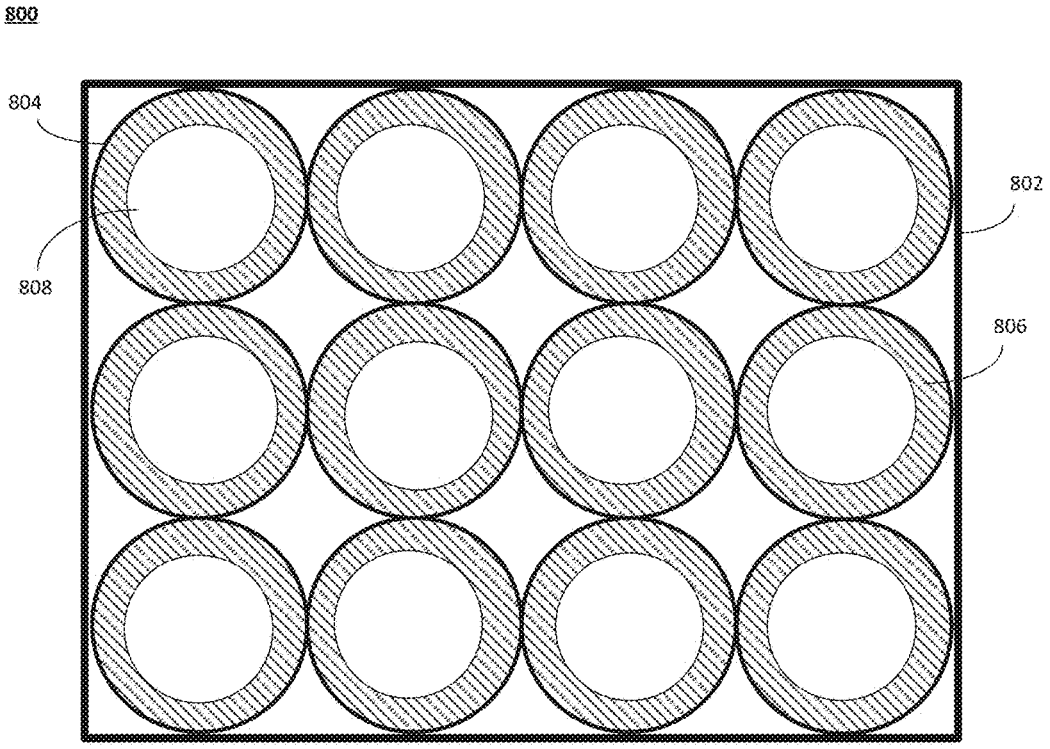
FIG. 8 is a cross-section diagram illustrating an embodiment of energized armor that includes three-dimensional shapes and explosive.

As described above, embodiments of energized armor system may include spheres that are filled with explosive. With reference now to FIG. 8 shown is an embodiment of energized armor 800 that includes explosive-filled three-dimensional shapes (e.g., spheres 804). Energized armor 800 includes a rectangular prism container 802, spheres 804 and explosive 806. The spheres 802 may be all of the same size or of varying sizes. The spheres 802 may be made of a variety of materials. In the embodiment shown, the spheres 802 are explosive packed BuckyBalls; in this embodiment, each sphere 802 includes a one and a half inch (1.5") diameter HDPE sphere filled with explosive 804 and a one inch (1") diameter PP sphere 808. See FIG. 9 for a detailed cross-section of the BuckyBall sphere 804.

As noted above, the spheres 804 may be randomly or orderly packed into the container 802. The explosive 806 may be inside the spheres 804, as described in the preceding paragraph. Alternatively or additionally, the explosive 806 may fill the spaces in the armor 800 between the spheres 804; these spaces are referred to herein as "void spaces". Accordingly, the explosive 806 may be inside the spheres 804, surrounding the spheres 804 or inside and surrounding the spheres 804. Any of a variety of explosives 806 may be used. For example, PETN explosive may be used. Likewise, embodiments may include octol explosive hot-poured into the armor 800 to fill the void-spaces. In the embodiment shown, ten (10) grams of PETN explosive was used to fill the spheres 804, with five (5) grams of PETN used to fill each hemisphere of the sphere 804 (with the one inch (1") PP sphere placed in the middle of the packed PETN in the center of the sphere 804).

Figure 9:
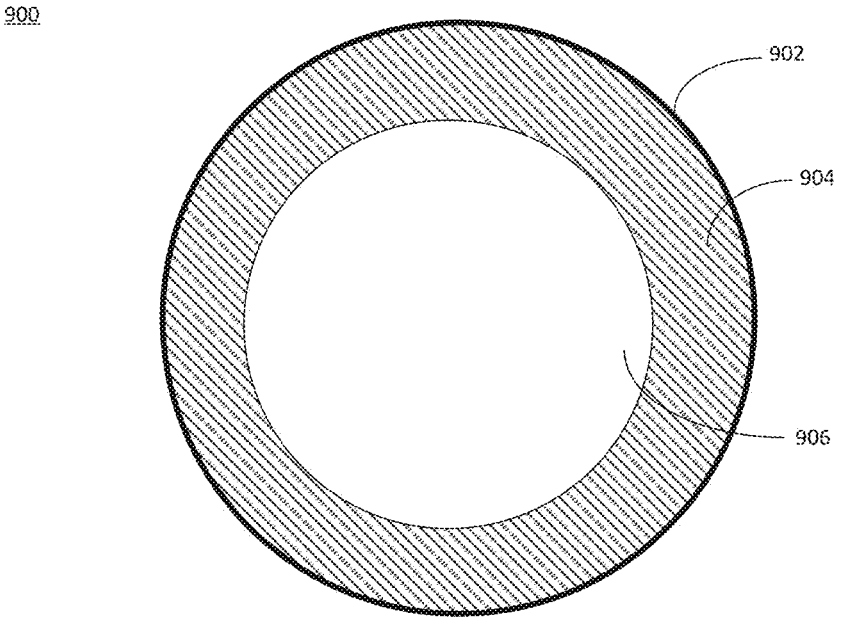
FIG. 9 is a cross-section diagram illustrating an embodiment of a three-dimensional shape and explosive used in embodiments of energized armor.

With reference now to FIG. 9, shown is a cross-section diagram illustrating an embodiment of the sphere 900, which may be used in embodiments of armor, including armor 800 shown in FIG. 8. As shown, the sphere 900 includes outer shell 902, explosive 904 and inner-sphere 906. Outer shell 902 may be larger HDPE sphere described above in connection with FIG. 8. Explosive 904 fills each hemisphere of outer shell 902. Inner-sphere 906 is placed at or roughly at center of outer shell 902, surrounded by explosive 904. Explosive 904 may be packed into each hemisphere of outer shell 902 and inner sphere 906 placed into explosive 904 at center of outer shell 902. Inner-sphere 906 may be PP sphere described above in connection with FIG. 8. Inner-sphere 906 may be hollow or solid.

Figure 10:
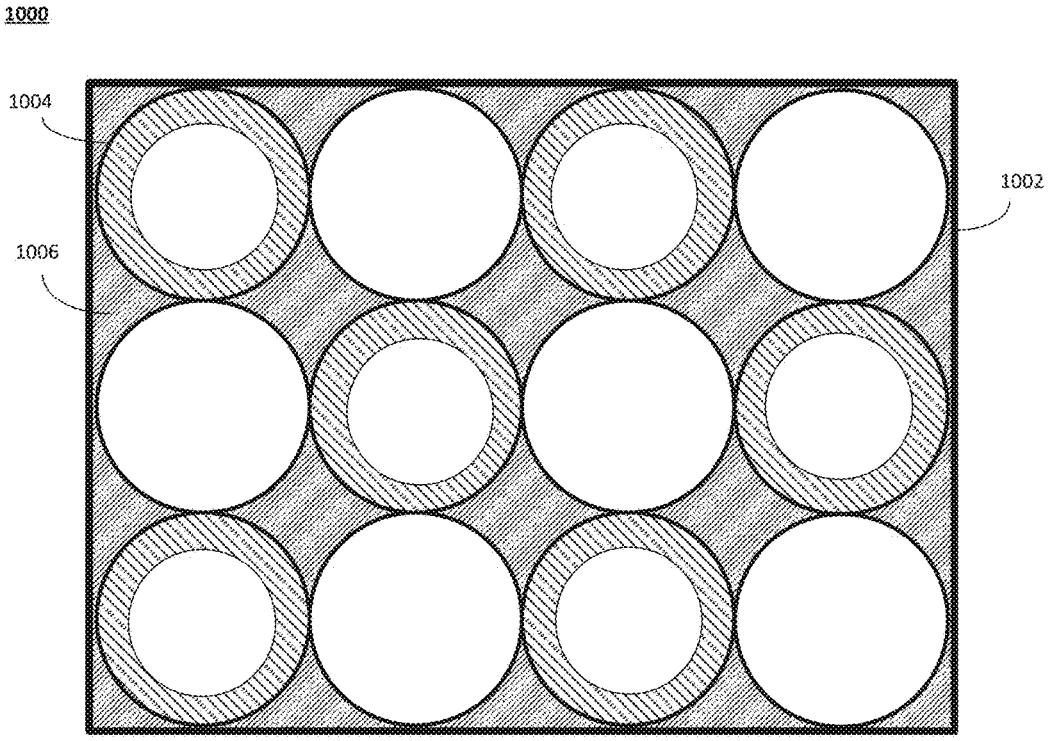
FIG. 10 is a cross-section diagram illustrating an embodiment of energized armor that includes three-dimensional shapes and explosive.

With reference now to FIG. 10, shown is another embodiment of energized armor 1000. Armor 1000 includes container 1002, spheres 1004 and a fill 1006. Spheres 1004 may be explosive-filled spheres constructed as described above with reference to FIGS. 8 and 9. Alternatively, spheres 1004 may be hollow spheres or a combination of hollow and explosive-filled spheres, as shown. Fill 1004 may be explosive filling void-spaces. Alternatively, fill 1004 may be a non-reactive fill such as sand, solidifying (urethane) foam, or a polymer such as Speedliner™ or Linex™.

Figure 11A:
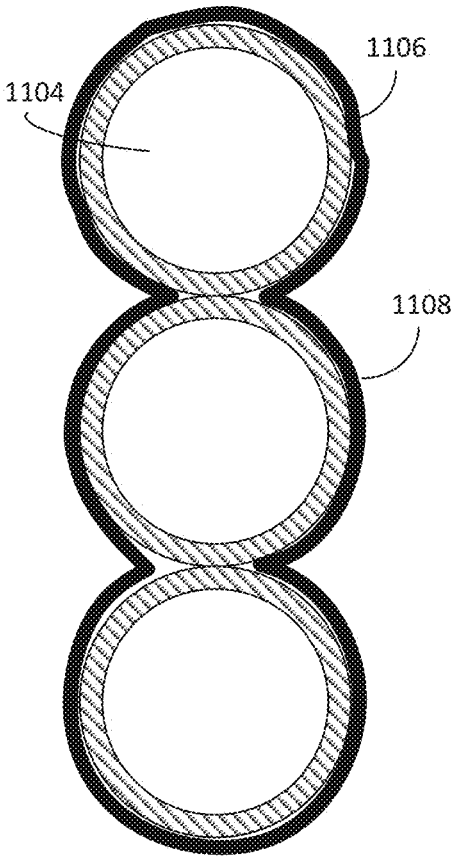
FIGS. 11A-11B are diagrams illustrating an embodiment of energized armor that includes three-dimensional shapes and explosive.
Figure 11B:
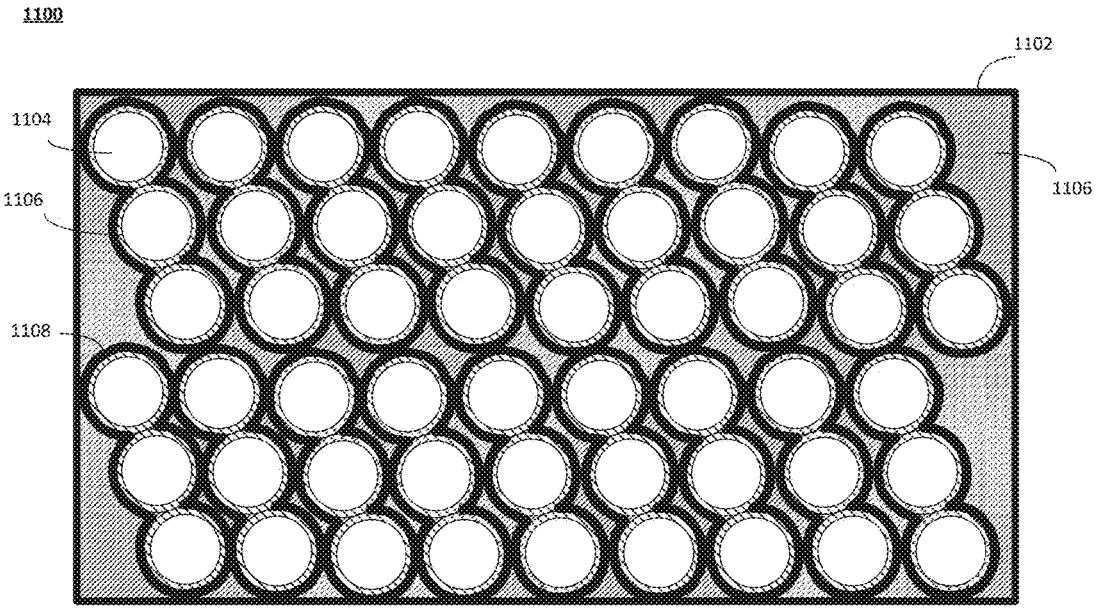

With reference now to FIGS. 11A and 11B, shown is another manner of packaging or arranging three-dimensional shapes (e.g., spheres) in embodiment of energized armor described herein. As above, armor 1100 may be a portion or compartment of a larger armor system. One or more spheres 1102 are encapsulated by a polymer 1108, such as a self-healing polymer (e.g., Speedliner™ or Linex™). The polymer 1108 may encapsulate a plurality of spheres 1104. In the embodiment shown, groups of three spheres 1104 are encapsulated by the polymer 1108. The polymer 1108 may also encapsulate explosive 1106 that is wrapped around spheres 1104. Alternatively, spheres 1104 may be explosive-filled. Additional explosive 1106 may also be placed on top of or around encapsulated spheres 1102.

With reference to FIG. 11B, shown is embodiment of armor 1100 including encapsulated spheres 1104. The encapsulated spheres 1104 are placed into container 1102. As shown, the encapsulated spheres 1104 may be randomly or otherwise packed into container 1102. Likewise, FIG. 11B illustrates that any size or number of three-dimensional shapes (e.g., spheres 1104) or size of container 1102 may be used for embodiments of armor systems described herein. The polymer 1108 encapsulation helps to better contain the spheres 1104, making them easier to handle in assembly of armor 1100. Additional explosive 1106 (or other fill as described in FIG. 10) may fill void-spaces between encapsulated spheres 1104 and between spheres 1104 and container 1102.

Figure 12:
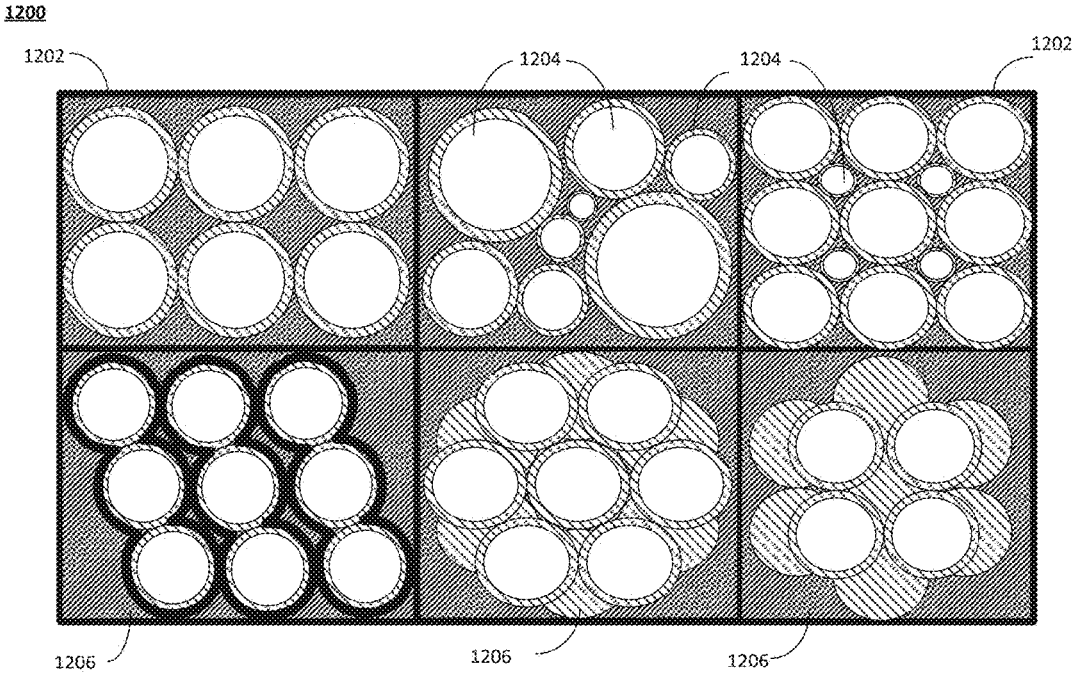
FIG. 12 is a diagram illustrating an embodiment of energized armor that includes three-dimensional shapes and explosive.

With reference now to FIG. 12, shown is an embodiment of energized armor system 1200 with a plurality of compartments or containers 1202 filled with a variety of size spheres 1204 and explosive 1206. Some spheres 1204 shown are explosive-filled spheres constructed as described above, while other spheres 1204 are hollow spheres. Some spheres 1204 are wrapped in explosive 1206. Explosive 1206 may be explosive fill in void-spaces surrounding spheres 1204. Different compartments 1202 may contain different configurations and arrangements of spheres 1204 and explosive 1206, as shown. For example, some compartments may contain explosive-filled spheres 1204 surrounded by an explosive 1206 in void-spaces, others may contain hollow spheres 1204 surrounded by an explosive 1206 in void-spaces, others may contain explosive-filled spheres 1204, and others may contain explosive-filled spheres 1204 with empty void-spaces. Some containers 1202 may include two or more different-size spheres 1204 arranged to tightly pack container 1202, as shown.

As described above, embodiments of energized armor systems may be configured to fit the needs of their application. For example, energized armor containers, as described herein, may be a variety of shapes and sizes, sized and shaped to best fit the system in and the vehicle on which the armor is being installed. Different dimensions and sizes of the containers and three-dimensional shapes (e.g., spheres) may be used. A variety of container, shape and explosive material may be used to provide different weight armor systems. Different configurations and arrangements of three-dimensional shapes may be used in the container. For example, exemplary armor systems may use alternating layers of spheres: (1) five (5) spheres, four (4) spheres, five (5) spheres, four (4) spheres, and five (5) spheres arranged in layers from top to bottom (non-threat side to threat side) in a 6×6×6 cubic container with explosive material wrapped around each sphere and/or in void spaces; (2) four (4) spheres, one (1) sphere, four (4) spheres, one (1) sphere and four (4) spheres arranged in layers from top to bottom (non-threat side to threat side) in a 6×6×6 cubic container with explosive material wrapped around each sphere and/or in void spaces; and (3) four (4) spheres, one (1) sphere, four (4) spheres arranged in layers with a gap (filled with an inert gapping material or an active explosive material) and an additional four (4) spheres, one (1) sphere, four (4) spheres arranged in layers on top of the gap, with explosive material wrapped around each sphere and/or in void spaces in a 8×8×8 cubic container. Different size cubic containers (and different shaped containers) may be used depending on the number of layers and size of the three-dimensional shapes. In the exemplary embodiments described, one inch (1") diameter spheres may be used.

Embodiments of energized armor systems may utilize the unique three-dimensional rigid core of embodiments described in the '691 application, the '104 patent and other related applications described above. Likewise, embodiments of energized armor systems described herein may incorporate different three-dimensional shapes besides the spheres described herein. Such three-dimensional shapes may include the hexagons and cylinders described in the '691 application, the '104 patent and other related applications described above.

Various embodiments of energized armor systems and various combinations of the energized armor embodiments described herein may be used to address a threat from EFPs, RPGs and threats. For example, multiple layers or compartments of energized armor embodiments described herein may be used. Containers of energized armor may be combined with layers of armor described in the '104 patent, the '553 patent, and/or the '761 patent. Such combinations may be configured, for example, as described in the '104 patent, the '553 patent, and/or the '761 patent. One of the many advantages of the energized armor and the armor described in the in the '104 patent, the '553 patent, and/or the '761 patent, is that these embodiments may be designed and combined to address virtually any threat.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. An armor system comprising:

a container, wherein the container includes a bottom, a top and sides and is enclosed;

hollow spheres that are placed in a stack in the container; and explosive that is wrapped around each of the hollow spheres in the container, wherein the explosive-wrapped spheres substantially fill the container.

2. The armor system of claim 1 wherein the container is a cube.

3. The armor system of claim 1 wherein the container is a rectangular prism.

4. The armor system of claim 1 wherein the container is made from a metal.

5. The armor system of claim 1 wherein the hollow spheres are made from a plastic.

6. The armor system of claim 1 wherein the spheres have a diameter chosen from a range of diameters from 1" to 3".

7. The armor system of claim 1 further comprising void spaces between the explosive-wrapped spheres and between the spheres and the container walls.

8. The armor system of claim 7 further comprising:

explosive fill in the void spaces, wherein the explosive fill fills substantially all of the void spaces; and one or more additional strips of explosive placed around the explosive-wrapped spheres.

9. The armor system of claim 1 further comprising an explosive sheet placed on top of the stack of explosive-wrapped spheres.

10. The armor system of claim 1 further comprising explosive sheets placed between various layers of explosive-wrapped spheres.

11. The armor system of claim 1 wherein the stack of explosive-wrapped spheres is a double-stack.

12. The armor system of claim 1 wherein the stack of explosive-wrapped spheres comprises layers of explosive-wrapped spheres that alternate in orientation to one another.

13. An armor system comprising:

a cubic container that includes a bottom, a top and sides;

a plurality of hollow shapes of a variety of sizes that are placed in the rectangular container;

explosive material that is wrapped around each of the hollow shapes substantially enclosing each of the hollow shapes; and explosive material that is placed in the container and fills spaces between the explosive-wrapped hollow shapes.

14. An armor system comprising:

an energized armor component that includes:

a cubic container that includes a bottom, a top and sides;

a plurality of hollow shapes of a variety of sizes that are placed in the rectangular container;

explosive material that is wrapped around each of the ho shapes substantially enclosing each of the hollow shapes; and explosive material that is placed in the container and fills spaces between the explosive-wrapped hollow shapes; and a passive armor component.

15. The armor system of claim 14 wherein the passive armor includes a three-dimensional core.

16. The armor system of claim 15 wherein the passive armor includes a plurality of tiles situated on the three-dimensional core.

* * * * *